US005462613A

United States Patent [19]

Glodowski et al.

[11] Patent Number: 5,462,613

[45] Date of Patent: Oct. 31, 1995

[54] METHOD AND APPARATUS FOR PRODUCING STEEL RODS WITH A DESIRED TENSILE STRENGTH AND MODEL FOR SIMULATING SAME

[75] Inventors: Robert J. Glodowski; Allyen E. Wilson, III, both of Kansas City, Mo.

[73] Assignee: GS Technologies Corporation, Kansas City, Mo.

[21] Appl. No.: 254,969

[22] Filed: Jun. 7, 1994

[51] Int. Cl.[6] ..... C21D 9/573

[52] U.S. Cl. ..... 148/500

[58] Field of Search ..... 148/500

[56] References Cited

U.S. PATENT DOCUMENTS 4,983,227 1/1991 Reiniche ..... 148/500

OTHER PUBLICATIONS

Emperical Models for Predicting the Mechanical Properties of Reinforcing Bar, O. Delvecchio, C. Young, I&SM, Oct. 1985, pp. 10–14.

Mathmetical simulation of Stelmor process, R. D. Morales, A. Lopez G., I. M. Olivares, Ironmaking and Steelmaking, 1991, vol. 18, No. 2, pp. 128–138.

Microstructural Engineering Applied to the Controlled Cooling of Steel Wire Rod, P. C. Campbell, E. B. Hawbolt, J. K. Brimacombe, Metallurgical Transactions A, Nov. 1991, vol. 22A, pp. 2769–2805.

Novel model for accurate calculation of hardenability and continuous cooling transformation, R. J. Mostert and C. T. van Rooyen, Materials Science and Technology, Sep. 1991, vol. 7, pp. 803–810.

*Primary Examiner*—Peter D. Rosenberg

*Attorney, Agent, or Firm*—Kokjer, Kircher, Bowman & Johnson

[57] ABSTRACT

A method and apparatus are provided for producing rods having a desired tensile strength from a rod manufacturing process set to an optimal operating condition. Initially, the rod manufacturing process is set in an optimal condition to produce rods at a maximum rate, while optimizing the mechanical properties therein. Raw materials are melted and a "heat of steel" representing one lot is poured into a ladle which is sampled to determine its chemical composition. The percentage content of each element is utilized within an empirical model modeling the rod manufacturing process to predict the tensile strength of rods. The empirical model is again utilized to determine the amount by which a control element must be varied to adjust the predicted tensile strength to the desired tensile strength. The control element represents an element, such as, carbon which significantly impacts the tensile strength of the rod. The predicted level of the control element necessary to achieve the target tensile strength is referred to as the "floating aim level" thereof. If the floating aim level exceeds a maximum accepted level for the control element the empirical model is again used to determine the necessary level of a second control element. Next, the heat of steel is trimmed to provide a lot having the target tensile strength.

21 Claims, 3 Drawing Sheets

METHOD AND APPARATUS FOR PRODUCING STEEL RODS WITH A DESIRED TENSILE STRENGTH AND MODEL FOR SIMULATING SAME

FIELD OF THE INVENTION

The invention generally relates to a method and apparatus for producing steel rods with a desired tensile strength by varying the content of one or more elements therein based upon an empirical model which simulates a rod manufacturing process.

BACKGROUND OF THE INVENTION

For years, high carbon rods have been prepared for wire drawing through a heat treating or "patenting" process in which the hot rolled rods are heat treated to optimize the pearlitic microstructure (and thus the tensile strength) of the high carbon rods. These rods are utilized in a variety of industries, such as to produce high carbon wire, mechanical spring wire, wire rope, prestressed concrete strand and the like. The high carbon rod must meet application specific mechanical properties, such as a desired tensile strength, ductility, hardenability and the like. The mechanical properties within rods formed through the parenting process were dependent upon the parenting process itself and the chemical composition of the elements making up the rod (i.e., the rod chemistry).

The rod buyer effected the parenting process as an initial step prior to transforming the rod to a desired end product. The tensile strength of the end product was a function of the buyer's parenting process and the rod's chemistry. Hence, in the industry, it became standard practice for the rod buyers to identify and order application specific rods by designating their chemical compositions in accordance with the AISI grading system, with the expectation of receiving rods having a heat treating response within a preferred range. Once the rods were heat treated or patented, they were transformed such as through a wire drawing operation, to produce the desired end product. As the resulting rod tensile strength is a function of the rod chemistry and the heat treating variables, chemistry, particularly carbon, became the key requirement to be specified by the rod buyer. The different manganese ranges of the AISI grades were generally chosen depending on the type of heat treatment process being used. These element levels represent fixed aim levels.

Once the chemistry was designated by the buyer, the rod supplier adjusted the heat chemistry to meet the "fixed" aim levels for elements designated by the buyer. The raw materials are melted in the furnace, which is tapped to obtain a lot or "heat" of steel. The "heat" of steel is poured into a ladle where it is tested to determine its chemistry (i.e., the percentage content of each element designated by the buyer and any other elements of interest). Next, the sampled element percentages are compared to the buyer designated percentages (fixed aim levels) to determine whether the heat of steel meets the buyer's specification. If not, the rod supplier adds an amount of each element to the ladle necessary to meet the fixed aim levels. In accordance with this process, it may be necessary to vary the quantity of multiple elements. Once the fixed aim levels are achieved, the heat of steel is rolled into rods. Hence, this process produced rods independent of, and without concern for, the mechanical properties of the rod.

In recent years, a new controlled cooling process commonly referred to as the "Stelmor" process has been implemented for producing high carbon rods without the use of a patenting step. Controlled cooling processes utilize a medium, such as air, water, molten salt and the like to supercool hot rolled rods in order to achieve a ferrite/pearlite microstructure having desired mechanical properties. With the introduction of the controlled cooling process, high carbon wire may be produced directly from hot rolled rods. Thus, it is possible to eliminate the patenting process so long as the rod is rolled to a diameter which is not unduly larger than the desired wire diameter. A substantial cost savings results from eliminating the patenting step. However, eliminating the patenting step created the need, within the rod mill, to produce hot rolled rods satisfying critical mechanical properties. Today, hot rolled rods have become useful in industries which are extremely demanding upon the mechanical properties of the rod.

Prior to the Stelmor process, the rod's mechanical properties were dependent upon the rod chemistry and the patenting process, with little consideration being afforded to the rod manufacturing process. However, present day rod mills utilizing a controlled cooling process, typically include a forced air cooling system with the ability to effect substantially the mechanical properties of the hot rolled rod. Thus, by varying the operating parameters of the rod manufacturing process, the rod supplier is able to vary the rod's mechanical properties.

With the advent of the forced air cooling system and the elimination of the heat treating step, the starting rod tensile strength has become a function of the rod chemistry and the rod manufacturing process, both of which are controlled by the rod supplier. Yet, the ordering system has not changed significantly. By necessity, the buyer (wire producer) had to use a trial and error procedure to determine the grades of steel needed for a specific end product (wire drawing practice) to obtain the tensile strengths required. The buyer learned to restrict various chemical element ranges within a grade to obtain better control of the rod tensile strength. The end result is that the buyer became the steel alloy designer. The August of 1993 version of the steel products manual, "Carbon Steel Wire and Rods", a publication of the Iron and Steel Society (which is incorporated by reference) includes a table showing typical average tensile strengths for a rod produced in a controlled cooling system as a function of carbon and manganese levels. From this table, the buyer could presumably estimate carbon and manganese aims to achieve a desired tensile strength.

The problem with this system is that there are additional variables in the rod manufacturing process, such as rolling temperatures, cooling rates, metallic and non-metallic residuals, and grain refining elements that also affect rod tensile strength. These variables may not be covered in typical rod specifications. As a result, the variation in tensile strengths of rods ordered to restricted chemistry ranges is still too large to meet desired tensile ranges consistently. This is particularly true when the buyer orders rod from different suppliers. Different suppliers may have quite different melting, casting, and rolling processes resulting in different rod tensile strengths for the same chemistry specification. Thus, the rod buyer must consider more than just the rod chemistry when specifying the grade of the desired rod with the expectation of the rod having desired mechanical properties.

For example, in the high carbon wire industry, an important mechanical property of a drawn wire is its breaking load or tensile strength. The finished wire tensile strength is dependent upon the wire drawing parameters (e.g., number of passes, amount of reduction per pass, total reduction)

which dictate the degree to which the tensile strength of the resulting wire is varied from that of the starting rod. If the tensile strength of the starting rod is too low or too high, the wire drawing parameters cannot be adjusted sufficiently to reach the desired wire tensile strength. Thus, the wire producer must have the correct starting rod tensile strength to meet consistently and predictably the required finished wire tensile strength.

However, designating rod chemistry based upon the AISI specifications did not ensure that the starting rod tensile strength would be within a desired range since the buyer had little control over the rod mill process and particularly the forced air cooling process therein. This uncertainty was further frustrated by the fact that different rod mills used different setups. As these parameters are varied, so is the resulting tensile strength. Thus, the buyer was afforded little security in obtaining a desired tensile strength by designating the general chemistry for such a rod.

The rod supplier has the option to adjust the rolling and cooling parameters of the rod manufacturing process to produce rods having the preferred tensile strength. However, the supplier's ability to effect tensile strength is limited. Further, as the supplier varies the rod manufacturing process parameters, it operates in a non-optimal configuration. Thus, the supplier is unable to maximize either the throughput of the rod mill or the quality characteristics (microstructure) of the rod. This non-optimal operation translates into increased production costs and/or reduced quality levels.

Additionally, the supplier's ability to minimize cost by using cheap raw materials is limited by the buyer's designated chemistry. Typically, a rod may be produced from a variety of chemistries, but with substantially the same mechanical properties. As certain elements are more expensive than others, it is preferable to maximize the use of the cheapest elements (including scrap) while maintaining the integrity of the rod's mechanical properties. However, when the buyer designates the chemistry, the supplier is unable to maximize the use of inexpensive elements within the rod. Thus, the rod may be composed of unnecessary percentages of more expensive elements. A particular chemistry may further prevent the supplier from using scrap raw material if this scrap includes an unduly high percentage of any element.

Heretofore, models have been proposed for simulating various aspects of the rod mill process including the model suggested in "Empirical Models for Predicting The Mechanical Properties of Reinforcing Bar" by O. Delvecchio and C. Young, published October of 1985 in the I & SM. Delvecchio suggests that knowledge of the rod chemistry alone may be insufficient for predicting the mechanical properties of reinforced bar. In Delvecchio's model, yield strength equals the sum of all of the element percentages, each of which is multiplied by a corresponding coefficient. However, each of Delvecchio's yield strength components affords a linear relation to the percentage content of the corresponding element. Delvecchio's model further considers the effect upon the yield strength by the type of steel making facility (e.g., electric arc, basic oxygen, etc.). However, the factor accounting for the facility type merely adds a constant yield strength value to the overall prediction for a particular steel mill (i.e., 16.7 MPa for the "Edmonton" facility which uses an electric arc furnace, and 46.3 MPa for the "McMasters" facility).

Other empirical models have been proposed, such as "Mathematical simulation of Stelmore Process" by R. D. Morales, A. Lopez G., and I. M. Olivares, *Ironmaking and Steelmaking,* 1991, Vol. 18, No. 2; "Novel Model For Accurate Calculation of Hardenability and Continuous Cooling Transformation", by R. J. Mosterr and G. T. van Rooyan, *Material Science and Technology,* September 1991, Vol. 7; and "Microstructural Engineering Applied to the Controlled Cooling of Steel Wire Rod: Parts I, II and II", by P. C. Campbell, E. B. Hawbolt and J. K. Brimacombe, *Metallurgical Transactions,* Vol. 22A, November 1991. Each of the above papers are incorporated by reference. However, none of these models address rod chemistry in combination with a rod manufacturing process.

The need remains within the industry to provide an alternative method and apparatus for producing high carbon rods, in which the supplier is afforded more flexibility with respect to the chemistry of the rods. The present invention is intended to meet this need.

SUMMARY OF THE INVENTION

It is an object of the present invention to provide a method and apparatus for producing rods, in which the rod mill is set to an optimal operating condition and the rod chemistry is varied by the supplier to achieve a tensile strength designated by the buyer.

It is another object of the present invention to provide a method and apparatus for producing rods in which buyers designate the mechanical properties, including tensile strength, of the rod and the supplier varies the rod chemistry to achieve this designation.

It is another object of the present invention to provide a method and apparatus for producing rods having a desired tensile strength by allowing the rod supplier to adjust the chemistry of the rod in accordance with an empirical model of that supplier's rod mill.

It is another object of the present invention to provide a method and apparatus for producing rods which utilize an empirical model of the rod mill process enabling the prediction of a rod tensile strength based upon rod chemistry.

It is another object of the present invention to provide a method and apparatus for producing rods in which the percentage of one or more elements therein is varied at an intermediate step within the rod manufacturing process to equal a floating aim level for such elements in order to obtain a desired rod tensile strength.

Another object of the present invention is to provide a method and apparatus for producing rods which reduce the affect of heat to heat chemistry variation upon the heat to heat tensile strength variation.

Another object of the present invention is to provide a method and apparatus for producing rods, the tensile strength variation of which results from the normal variation of one element, not the sum of the variations of each element within the rod.

In summary, a method and apparatus are provided for producing rods having a desired tensile strength (designated by a buyer) from a rod mill set to an optimal operating condition. Initially, the rod mill is set in an optimal condition to produce rods at a maximum rate, while optimizing the mechanical properties therein. Raw materials are melted within a furnace. The furnace is tapped and a "heat of steel" representing one lot is poured into a ladle which is sampled to determine its chemical composition. The percentage content of each element is utilized within an empirical model modeling the rod mill, as set in its optimal operating condition, to predict the tensile strength of rods to be rolled.

The predicted tensile strength is compared to the target desired tensile strength (e.g. buyer designated) to determine the difference. Next, the empirical model is again utilized to determine the amount by which a control element must be varied to adjust the predicted tensile strength to the desired tensile strength. The control element represents an element, such as, carbon which significantly impacts the tensile strength of the rod. The predicted level of the control element necessary to achieve the target tensile strength is referred to as the "floating aim level" thereof. If the floating aim level exceeds a .maximum accepted level for the control element the empirical model is again used to determine the necessary level of a second control element (with the first .control element set at its maximum level) to achieve the desired tensile strength. Once the floating aim levels for one or more control elements are identified by the empirical model, the actual levels for each control element within the sampled heat of steel are adjusted to equal the predicted floating aim levels to provide a lot with a predicted composition corresponding to the target tensile strength. The empirical model uses the following equation:

$$T_{stng} = \left[\sum_{n=1}^{N} \alpha_n ELMT_n\right] + \beta(size) + \left[\sum_{m=1}^{M} (\Gamma_m (ELMT_{size})_m(\text{size}))\right] + \sum_{i=1}^{I} \Delta_i (ELMT_{poly})_i^2; \quad (6)$$

where $T_{stng}$ equals the predicted tensile strength, $\alpha_n$ represents the coefficient for the $n^{th}$ element, "$ELMT_n$" equals the sampled percentage content of the $n^{th}$ element, $\beta$ represents the coefficient for the rod size factor, "size" represents the rod size, $(ELMT_{size})_m$ represents the percentage content of the $m^{th}$ rod size dependent element, the tensile strength contribution for which varies dependent upon rod size, $F_m$ represents the coefficient for the $m^{th}$ size dependent element $ELMT_{size}$, $(ELMT_{poly})_i$ represents the percentage content of the $i_{th}$ non-linear element which exhibits a non-linear relation to tensile strength and $\Delta_i$ represents the polynomial coefficient of the $i^{th}$ non-linear element.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figures 1, 2:
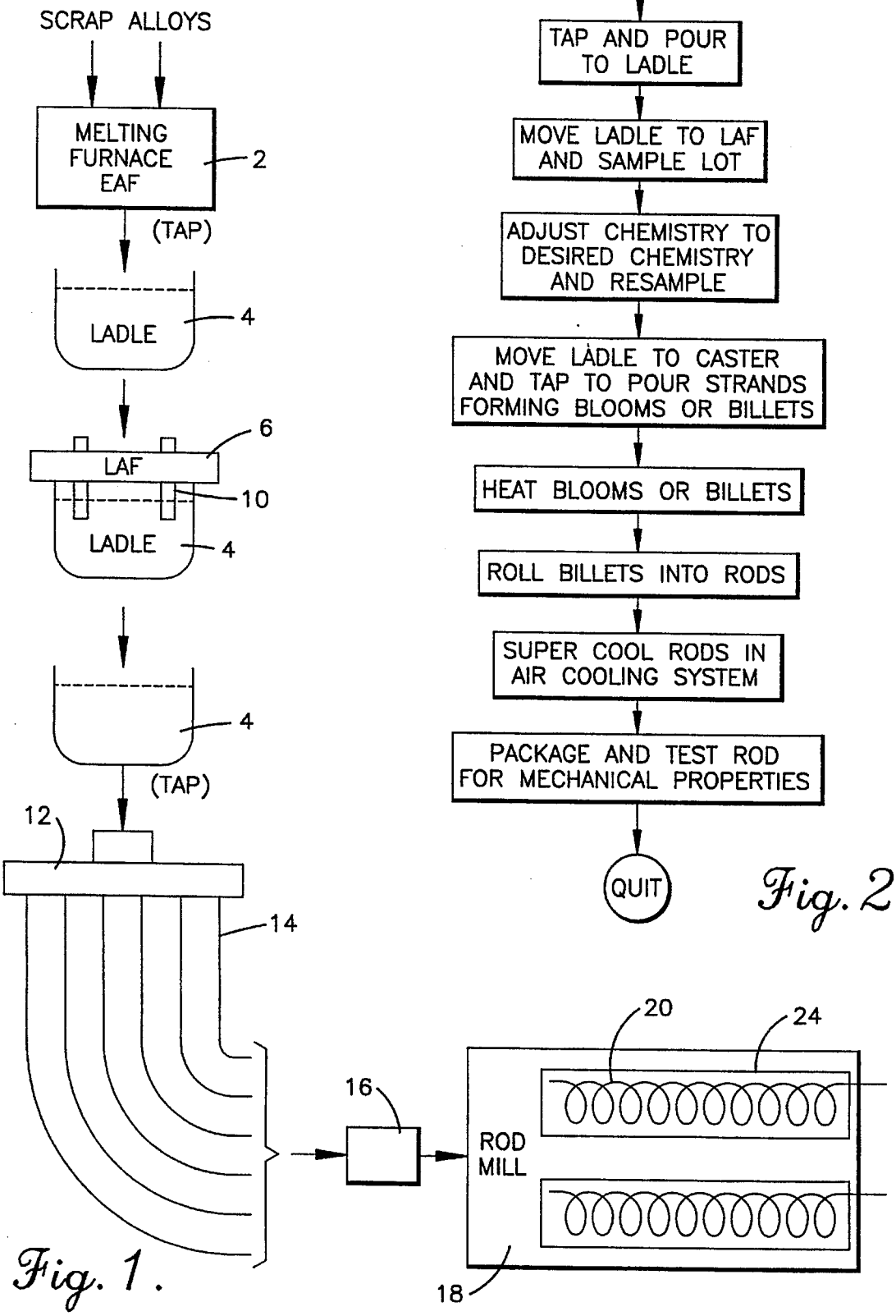
FIG. 1 illustrates a block diagram of a rod manufacturing process utilized in accordance with the present method and apparatus.
FIG. 2 illustrates a flow chart showing the processing sequence utilized to obtain an empirical model of the rod manufacturing process according to the present invention.

FIG. 1 generally illustrates a rod manufacturing process which is used to produce rods having a target tensile strength equal to that designated by a buyer. As an overview, the rod manufacturing process includes a melt furnace 2, such as an electric arc furnace (EAF), which is used to melt the scrap raw material and alloys to a molten state. Once melted, it is tapped and poured into a ladle 4 as a lot (also referred to as a "heat of steel") which is transported to a ladle arc furnace 6 (LAF). Within the LAF 8, the heat of steel from the ladle 4 is sampled to determine its chemical composition (also referred to as its chemistry). The chemistry is utilized within an empirical model modeling the rod manufacturing process to predict the tensile strength of rods rolled from the sampled lot. The empirical model is also used to calculate a percentage content (also referred to as a floating aim level) of one or more control elements. The aim level represents a percentage content of the control elements necessary to obtain the desired target tensile strength. Next, the lot is "trimmed" by adding one or more control elements, such as carbon, vanadium and the like, to the lot until its chemistry includes a percentage of the control element equaling the floating aim level. The electrodes 10 in the ladle arc furnace are used to adjust the temperature of the melted steel for optimum casting conditions. Thereafter, the lot is resampled to obtain its new chemistry, which is used to calculate its new predicted tensile strength. Optionally, the LAF may be removed so long as a ladle treatment station is present for sampling and final trim.

This sampling and predicting process is repeated until the predicted tensile strength coincides with a target tensile strength. Hence, the lot is trimmed to adjust the predicted tensile strength to correspond to the designated tensile strength. Thereafter, ladle 4 is moved to a caster 12 at which the lot is tapped from the bottom of the ladle 4 and poured into a caster 12. The caster 12 casts multiple blooms or billets 14 of steel, such as 7¾"×7¾" blooms or billets.

Next, the blooms 14 may be heated and rolled in a rolling mill to produce billets, such as with a 4"×4" cross-section. The billets 16 are then heated and rolled in a rod mill 18 to produce rod 20, such as having a diameter of 7/32" to 9/16" round. The rod mill includes a controlled cooling system 22, in which the rod 20 is laid upon conveyors 24 in a coiled pattern and forced air is blown through the coils of rod 20.

The mechanical properties of the resulting rod may be effected by a plurality of parameters, such as chemistry, rolling temperature, laying head temperature, solidification rate, cast size, cast speed, conveyor speed, air flow rate, and the like. Certain parameters have more effect than other parameters, such as chemistry, conveyor speed and air flow rate. A majority of the parameters, except for chemistry also effect the rate at which rod may be produced and other rod characteristics. For instance, the laying head temperature effects the thickness of the scaling layer (oxide covering) upon the rod. The optimal scale thickness varies depending upon the cleaning technique used by the buyer (e.g., a thin scale is preferred for chemical/acid cleaning and a thick scale is preferred for mechanical cleaning). The conveyor speed and air volume effect the transformation temperature at which the rod microstructure converts from an austenitic grain structure to a ferrite/pearlite structure. Absent external circumstances, this transformation occurs at approximately 1320° F. Transformation at this temperature occurs quite slowly, and consequently produces a ferrite/pearlite microstructure having undesirable mechanical properties, such as a low tensile strength. A desirable microstructure is produced when the rod is supercooled and thus the transformation temperature is reduced, optimally, to approximately 1000° F. The controlled cooling system is able to reduce the transformation temperature to near 1000° F., by adjusting the conveyor speed and air flow to increase the cooling rate as necessary. However, the conveyor speed and flow rate may be over compensated, and thus the transformation temperature falls below 1000° F. An insufficient transformation temperature detrimentally effects the microstructure and rod mechanical properties. Thus, the cooling system parameters are set to provide a transformation temperature as close to, but not exceeding 1000° F. Once these parameters are set, the cooling system exhibits a predicted cooling characteristic (which may be represented by a linear decreasing relation between the transformation temperature and the cooling rate, namely as the cooling rate increases, the transformation temperature decreases. This relation may be referred to as the cooling system transformation effect. Each rod chemistry corresponds to a particular transformation characteristic which substantially resembles a non-linear parabolic curved relation between transformation temperature and cooling rate with the curve's vertex near 1000° F., which may vary depending upon the alloy composition. Once this relation is set, the chemistry of the rod may be adjusted, to provide a transformation characteristic therefore which intersects the cooling systems linear decreasing transformation effect at a desired temperature (as close to the optimum transformation temperature as possible without falling therebelow). Thus, it is advantageous to set all processing parameters, except for chemistry, at an optimal level to achieve maximum throughput and an optimal microstructure, such as an optimal ferrite/pearlite structure within the rod.

The Melt Shop Model

Next, the rod manufacturing process model and the method for calculating this model is described in connection with FIG. 2. As noted above, to accurately predict the tensile strength, the present model accounts for the chemistry forming the rod and the rod manufacturing process used to produce the rod. In the preferred embodiment, the rod manufacturing process has been set to an optimal processing condition, thereby ensuring that the rod manufacturing process exhibits a substantially constant effect upon the rod tensile strength at all times). Thus, the model for the preferred embodiment of the rod manufacturing process need not include variables which separately account for adjustments in the setting of the rod manufacturing process. However, such variables could be easily included, such as to account for the cooling system. Maintaining the rod manufacturing process in a constant processing state ensures optimal throughput of rods and allows the model to focus more specifically upon the relation between the rod chemistry and tensile strength.

Generally, this model is derived from correlating multiple sets of rod chemistries from an equal plurality of heats of steel with corresponding processing parameter settings in the rod manufacturing process and with corresponding mechanical properties from resulting rods. This correlation is utilized to provide an accurate estimation of the rod's mechanical properties as a function of the rod size, chemistry and rod manufacturing processing parameters.

In the preferred embodiment, the rod manufacturing processing parameters are set to maximize its throughput of rods with optimal mechanical properties.

As illustrated in FIG. 2, scrap and alloy are added to the electric arc furnace and melted. Thereafter, the molten solution is tapped and poured into the ladle which is subsequently moved to a ladle arc furnace. Next, the ladle is sampled and the samples are analyzed to obtain the lot's chemistry. The chemistry is adjusted to a desired level based on these samples. Once a desired chemistry is obtained, the ladle is moved to a caster and tapped to form multiple blooms or billets. The blooms or billets are cooled, moved from the melt shop to the rolling mill and reheated. Next, the blooms or billets are rolled to form rods distributed in coils (as illustrated in FIG. 1) upon conveyors which transport the rods through the air cooling system. The resulting rods are packaged into coils and subsequently sampled and tested to obtain the resulting rod's mechanical properties (such as tensile strength and ductility).

A database records the percentage content of each element from the final chemistry that contributes to a mechanical property of interest, such as the tensile strength, hardenability, solid solution strengthening, precipitation hardening effects and the like. Once rolled, the rods are tested to obtain samples near the beginning and the end of a lot in order to obtain an average rod tensile strength from the lot. For instance, if the rods are rolled in four side by side strands, then eight tensile strength samples will be obtained for each lot. These tensile strength samples are averaged and this average is recorded in the database with the corresponding element percentage data and processing parameter settings. The average tensile strength is stored as the dependent variable within the model being developed.

In the model, the effect of the rod chemistry upon tensile strength has been separated into five primary components which are represented by the following equation:

$$T_{stng}=T_{elmt}+T_{sz}+Intercept+T_{sz\text{-}var}+T_{poly} \quad (1)$$

where $T_{stng}$ represents the tensile strength of the resulting rod, $T_{elmt}$ represents the linear component of tensile strength attributed by the percentage contents of the individual elements within the rod, $T_{sz}$ represents the tensile strength component contributed by the size of the rod, "Intercept" represents a constant necessary to account for a tensile strength bias component occurring within each test data set, $T_{sz\text{-}var}$ represents a variation in the linear tensile strength component attributed by elements that are rod size dependent, and $T_{poly}$ represents a non-linear tensile strength component attributed by the percentage contents of certain elements. Each tensile strength component is explained in more detail below.

Generally, the chemistry may be categorized into four primary groups of elements, namely metallic residuals (e.g., nickel, copper, chromium and the like), non-metallic residuals (e.g., phosphorous, sulfur, nitrogen and the like), deoxidizing materials (e.g., manganese, silicon and the like) and control elements (e.g. carbon, vanadium and the like). It is preferable to maintain the metallic and non-metallic residuals below certain maximums, otherwise, they detrimentally effect the mechanical properties. The manganese content improves ductility and hardenability. The control elements strongly increase tensile strength, however, cannot exceed maximums. Otherwise, the control elements may adversely effect other mechanical properties, such as ductility (for instance, when carbon exceeds 0.90).

The variable $T_{elmt}$ represents the sum of the linear tensile strength components, positive or negative, attributed by each individual element. The variable $T_{elmt}$ only accounts for the effects of each element upon tensile strength, and is represented by the equation:

$$T_{elmt} = \sum_{n=1}^{N} \alpha_n ELMT_n; \quad (2)$$

where $\alpha_n$ represents the coefficient for the $n^{th}$ element, $ELMT_n$ represents the percentage content by weight of the $n^{th}$ element within the chemistry of the rod and N represents the total number of elements accounted for within the model.

The tensile strength component afforded by each individual element upon the tensile strength of the rod does not necessarily maintain a linear relation with the percentage content of the individual element within the chemistry. Instead, for certain elements, (referred to as control elements) an incremental increase or decrease in tensile strength based upon an incremental change in the level of that particular element is best illustrated by a polynomial equation (see FIGS. 3*a* and 3*b*). The control elements represent those elements which substantially effect the tensile strength and which do so in a non-linear manner.

Figure 3A:
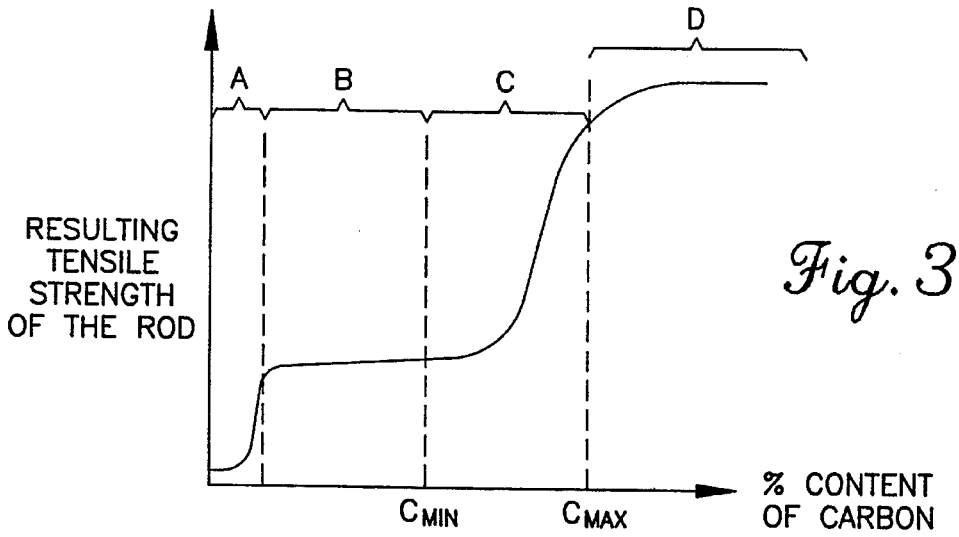
FIGS. 3A and 3B illustrate relations between tensile strength and percentage content by weight of carbon and vanadium.

FIG. 3A illustrates a relation between the percentage content by weight of carbon and the resulting tensile strength of the rod. This relation is represented by a polynomial equation of the nth order. However, in a high carbon rod manufacturing process, a limited range of carbon percentage contents is of use. Thus, only an intermediate region C of this curve is of interest. The region C extends from a carbon minimum percentage $C_{min}$ to a carbon maximum percentage $C_{max}$. Within the range of interest C, the relation between the carbon percentage content and the resulting rod tensile strength can be substantially approximated by a second order polynomial.

If the percentage content of carbon falls below the minimum $C_{min}$, the carbon content has a substantially minor affect upon the resulting tensile strength. This phenomenon results from the fact that, within region B, iron carbide within the rod is formed with a microstructure having a large austenitic grain size. When the carbon content is below the minimum $C_{min}$, the microstructure does not undergo a transformation to a ferrite/pearlite structure. Iron carbide with the pearlitic structure affords a substantial contribution to the tensile strength, while iron carbide with the ferritic grain structure affords a lesser contribution. Thus, when the percentage content of carbon falls below the minimum $C_{min}$, it is of less consequences for effecting tensile strength. The first region A represents the rod microstructure in which the carbon remains soluble within the ferrite (e.g. 0.005% or less content). Region D represents the relation between carbon content and resulting rod tensile strength when the carbon content exceeds a maximum $C_{max}$. Once the carbon content exceeds this maximum, the microstructure forms an eutectoid composition. Specifically, at the maximum $C_{max}$, the microstructure affords a 100% pearlitic structure and thereafter the microstructure corresponds to a composition, the tensile strength of which is less responsive to the carbon content. Thus, it is preferential to maintain the carbon content of the rod within the region of interest C to ensure the maximum correlation between the pearlitic structure and the carbon content, thereby affording maximum control over the tensile strength by adjusting a single control element.

Figure 3B:
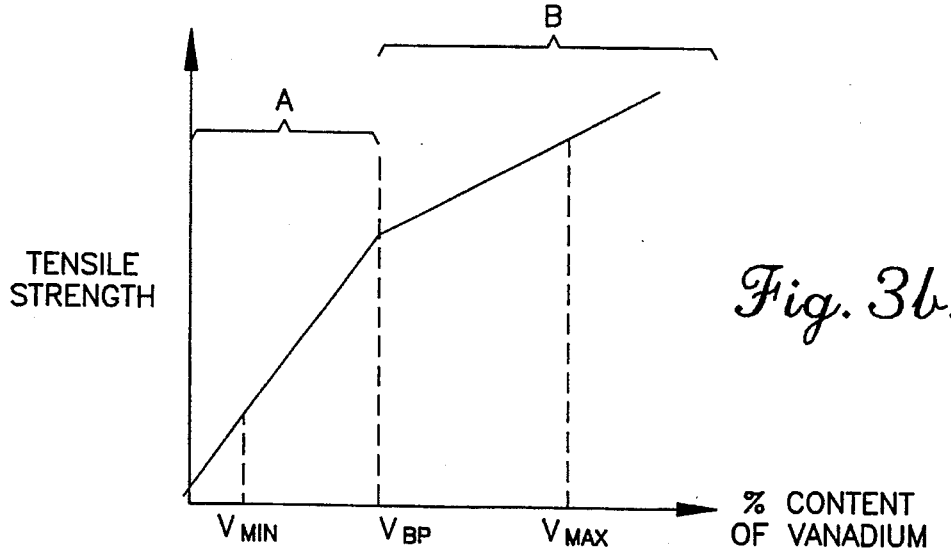

FIG. 3B illustrates a relation between a second control element, vanadium, and the resulting rod tensile strength. This curve includes two substantially linear segments intersecting at a point corresponding to a break point $V_{bp}$. The first region A of this curve has a slope substantially greater than that of the curve within the second region B. The break point within FIG. 3B in tensile strength contribution of the control element vanadium can be attributed to the chemical processes undergone within a lot. Specifically, vanadium combines with other elements during processing. When vanadium combines with nitrogen, it forms vanadium nitride which affords a substantial contribution to tensile strength as compared to other compositions which may be formed comprising vanadium. Vanadium and nitrogen combine in an stoichiometric relation (i.e., in a one-to-one relation with one atom of nitrogen combining with one atom of vanadium). The break point $V_{bp}$ corresponds to the point at which all of the available nitrogen elements within the rod have combined with vanadium or some other element. Thereafter, if additional vanadium is added it combines with other elements, the resulting composition of which affords a lesser affect upon tensile strength.

In some instances, it may be desirable to add vanadium in excess of the breakpoint $V_{bp}$, such as up to a maximum $V_{max}$. Thus, it is necessary to model the control element vanadium in a manner to account for its non-linear contribution to tensile strength about the break point $V_{bp}$. In view of the foregoing examples, it is clear that a non-linear model may be provided for any desirable control element to account for such an elements non-linear effects upon tensile strength.

In the preferred embodiment, it may be assumed that the non-linear contributions of metallic and non-metallic residuals are disregarded as negligible and that the non-linear contribution of the control elements above the second degree are also negligible. Hence, the non-linear affect upon the tensile strength is illustrated by the following equation:

$$T_{poly} = \sum_{i=1}^{I} \Delta_i (ELMT_{poly})_i^2; \quad (3)$$

where $(ELMT_{poly})_i$ represents the $i^{th}$ control element, and where $\Delta_i$ represent coefficient for the $i^{th}$ control element. While the effects of the control elements upon tensile also include a first order (i.e., linear) component, this component is accounted for in the linear tensile strength component $T_{elmt}$ along with the linear tensile strength contribution of every other element within the rod.

Figure 4:
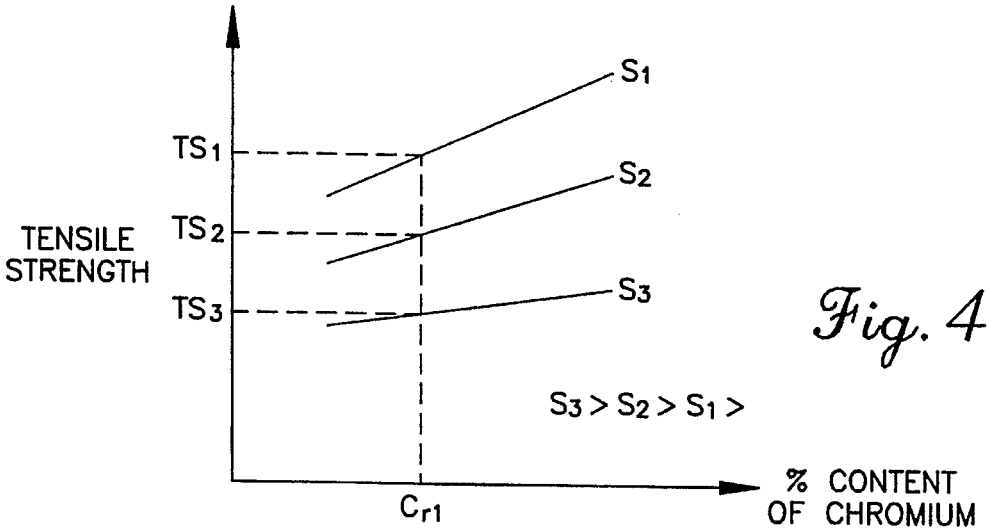
FIG. 4 illustrates a relation between tensile strength and percentage content of manganese.

Turning to the tensile strength component of size dependent elements $T_{sz\text{-}var}$, the tensile strength contribution by each element is not solely dependent upon the percentage content of such an element. Instead, certain elements contribute to, or detract from, the tensile strength of the rod by a varying amount for a fixed percentage of the element. The amount of variation is dependent partially upon the size of the rod. Thus, the instant model includes a tensile strength factor which is able to represent accurately the change in a particular element's contribution to, or detraction from, tensile strength as the rod size changes. FIG. 4 illustrates a series of lines between a percentage content of the size dependent element chromium and the resulting rod tensile strength. Each line corresponds to a rod having a different size $S_1$–$S_3$, wherein the first rod size $S_1$ is less than the second rod size $S_2$ is less than the third rod size $S_3$. As illustrated in FIG. 4, as the rod size increases, the affect upon tensile strength of the percentage content of chromium decreases in magnitude and in slope. As illustrated in FIG. 4, the contribution to tensile strength of a chromium content $Cr_1$ may equal $TS_3$, $TS_2$ or $TS_1$ depending upon the size $S_3$–$S_1$, to which the rod is rolled. Additional elements, particularly those that effect hardenability (e.g., manganese, silicon and the like), contribute a variable amount to tensile strength, the magnitude of which is dependent upon the rod size. These additional rod size dependent elements exhibit a similar series of linear curves. The rod size dependent factor is illustrated by the following equation:

$$T_{sz\text{-}var} = \sum_{m=1}^{M} \Gamma_m (ELMT_{size})_m (\text{Size}); \quad (4)$$

where $ELMT_{size}$ represent the percentage content of the $m^{th}$ size dependent element which is sensitive to rod size, Size represents the rod size and $\Gamma_m$ represent the coefficient for the $m^{th}$ size dependent element.

The variable $T_{sz}$ represents the tensile strength component attributed by the size of the rod and can be represented by the equation:

$$T_{sz} = \beta(Size) \quad (5)$$

where "Size" represents the size of the rod and $\beta$ represents the coefficient thereof.

Equation 1 can be rewritten in terms of equations 2–5 as follows:

$$T_{stng} = \left[ \sum_{n=1}^{N} \alpha_n ELMT_n \right] + \beta(size) + \left[ \sum_{m=1}^{M} (\Gamma_m (ELMT_{size})_m (\text{size})) \right] + \sum_{i=1}^{I} \Delta_i (ELMT_{poly})_i^2; \quad (6)$$

Once the above model structure is established and the test data accumulated, the coefficients $\alpha_n$, $\beta$, $\Gamma_m$, and $\Delta_i$ are calculated through linear regression techniques based upon the test data. The following Tables 1–6 illustrate sample test data obtained for three rod sizes, wherein the rod manufacturing process was repeated for 10 heats of steel for 3 rod sizes. More specifically, Tables 1, 3 and 5 illustrate ten columns, each of which represents a different heat of steel or run. Within Tables 1, 3 and 5, the first row designates the target tensile strength (also referred to as the specification tensile strength), the second row refers to the heat number, the final two rows represent the predicted tensile strength and predicted rod size, and the remaining rows correspond to the percentage content of each element within the rod. Tables 2, 4 and 6 compare the predicted and actual tensile strengths for the heats of steel within Tables 1, 3 and 5, respectively. For instance, Table 4 corresponds to a target tensile strength of 155 ksi for a rod having a diameter of 9/32 inches. Of the lots ran according to this specification, the mean actual tensile strength equalled 155.706 ksi while the mean predicted tensile strength equalled 154.902 ksi, providing a difference therebetween of 0.804 ksi. By way of example only, Table 7 below illustrates the coefficients for each element, the Intercept, the Size, the non-linear elements and the rod size dependent elements utilized within the present model. Tables 7–9 illustrate regression statistics for this example.

TABLE 1

| Spec | 130A | 130A | 130A | 130A | 130A | 130A | 130A | 130A | 130A | 130A |
|---|---|---|---|---|---|---|---|---|---|---|
| Heat | 34221 | 34222 | 34223 | 34225 | 34226 | 34227 | 34228 | 34407 | 34542 | 34544 |
| C | 0.530 | 0.530 | 0.550 | 0.540 | 0.540 | 0.540 | 0.540 | 0.530 | 0.550 | 0.560 |
| Mn | 0.65 | 0.65 | 0.65 | 0.64 | 0.65 | 0.67 | 0.64 | 0.66 | 0.66 | 0.63 |
| P | .011 | .008 | .009 | .019 | .007 | .007 | .009 | .008 | .008 | .009 |
| S | .021 | .017 | .020 | .018 | .018 | .016 | .018 | .013 | .012 | .020 |
| Si | 0.22 | 0.22 | 0.24 | 0.24 | 0.25 | 0.24 | 0.24 | 0.22 | 0.23 | 0.25 |
| Ni | 0.07 | 0.07 | 0.06 | 0.05 | 0.07 | 0.07 | 0.08 | 0.08 | 0.06 | 0.07 |
| Cr | 0.12 | 0.11 | 0.10 | 0.11 | 0.12 | 0.09 | 0.10 | 0.11 | 0.10 | 0.09 |
| Mo | 0.028 | 0.012 | 0.018 | 0.019 | 0.016 | 0.020 | 0.016 | 0.013 | 0.010 | 0.009 |
| Cu | 0.17 | 0.19 | 0.17 | 0.15 | 0.16 | 0.17 | 0.19 | 0.21 | 0.19 | 0.20 |
| V | .001 | .000 | .001 | .000 | .000 | .001 | .001 | .000 | .000 | .000 |
| N | .0048 | .0060 | .0057 | .0059 | .0045 | .0062 | .0060 | .0062 | .0077 | .0065 |
| B | .0001 | .0002 | .0002 | .0002 | .0002 | .0002 | .0002 | .0001 | .0001 | .0001 |
| Ti | .001 | .001 | .001 | .001 | .001 | .001 | .001 | .001 | .001 | .001 |
| Sn | .010 | .010 | .011 | .010 | .012 | .010 | .010 | .011 | .011 | .011 |
| Al | .001 | .001 | .001 | .001 | .001 | .001 | .008 | .004 | .000 | .000 |
| Cb | .001 | .001 | .001 | .001 | .001 | .001 | .001 | .001 | .001 | .001 |
| As | .0060 | .0060 | .0060 | .0050 | .0070 | .0060 | .0070 | .0080 | .0070 | .0070 |
| Pred Tens | 128.6 | 127.8 | 131.2 | 130.9 | 129.9 | 129.5 | 129.5 | 128.5 | 131.6 | 132.2 |
| Pred Size | .219 | .219 | .219 | .219 | .219 | .219 | .219 | .219 | .219 | .219 |

TABLE 2

Spec: 130A
Size: 7/32

| | | | | | | | | |
|---|---|---|---|---|---|---|---|---|
| Average Tensile | Mean | 130.726 | Std Dev | 2.270 | Minimum | 125.830 | Maximum | 139.985 |
| Predicted Tensile | Mean | 130.435 | Std Dev | 1.305 | Minimum | 127.752 | Maximum | 132.493 |
| Tensile Delta | Mean | 0.350 | Std Dev | 2.004 | Minimum | −3.397 | Maximum | 9.856 |
| Tensile Test Std Dev | Avg Std Dev | 2.183 | Min Std Dev | 0.902 | Max Std Dev | 7.808 | | |
| Range of Tests | Avg Range | 6.265 | Min Range | 2.060 | Max Range | 17.420 | | |

TABLE 3

| Spec | 155C | 155C | 155C | 155C | 155C | 155C | 155C | 155C | 155C | 155C |
|---|---|---|---|---|---|---|---|---|---|---|
| Heat | 34383 | 34384 | 34384 | 34385 | 34386 | 34388 | 35016 | 35018 | 35111 | 35112 |
| C | 0.720 | 0.720 | 0.720 | 0.720 | 0.730 | 0.730 | 0.740 | 0.750 | 0.710 | 0.710 |
| Mn | 0.64 | 0.67 | 0.67 | 0.66 | 0.65 | 0.64 | 0.65 | 0.64 | 0.68 | 0.66 |
| P | .006 | .007 | .007 | .006 | .007 | .005 | .006 | .006 | .010 | .009 |
| S | .016 | .011 | .011 | .011 | .012 | .009 | .015 | .011 | .013 | .014 |
| Si | 0.24 | 0.25 | 0.25 | 0.25 | 0.24 | 0.24 | 0.24 | 0.22 | 0.24 | 0.22 |
| Ni | 0.06 | 0.06 | 0.06 | 0.05 | 0.05 | 0.05 | 0.05 | 0.06 | 0.06 | 0.07 |
| Cr | 0.10 | 0.10 | 0.10 | 0.08 | 0.09 | 0.07 | 0.07 | 0.07 | 0.13 | 0.10 |
| Mo | 0.009 | 0.009 | 0.009 | 0.009 | 0.009 | 0.009 | 0.013 | 0.021 | 0.017 | 0.012 |
| Cu | 0.18 | 0.16 | 0.16 | 0.20 | 0.16 | 0.14 | 0.12 | 0.10 | 0.18 | 0.20 |
| V | .001 | .001 | .001 | .001 | .001 | .001 | .001 | .001 | .002 | .001 |
| N | .0062 | .0062 | .0062 | .0057 | .0060 | .0065 | .0044 | .0058 | .0067 | .0068 |
| B | .0001 | .0001 | .0001 | .0001 | .0001 | .0001 | .0002 | .0002 | .0000 | .0001 |
| Ti | .001 | .001 | .001 | .001 | .001 | .001 | .001 | .001 | .001 | .001 |
| Sn | .008 | .009 | .009 | .008 | .013 | .011 | .008 | .007 | .010 | .012 |
| Al | .001 | .001 | .001 | .002 | .001 | .001 | .002 | .002 | .001 | .002 |
| Cb | .001 | .001 | .001 | .001 | .001 | .001 | .001 | .001 | .000 | .001 |
| As | .0060 | .0060 | .0060 | .0060 | .0060 | .0060 | .0070 | .0070 | .0070 | .0060 |
| Pred Tens | 154.6 | 155.6 | 155.6 | 154.9 | 155.8 | 154.2 | 155.2 | 156.0 | 156.8 | 154.1 |
| Pred Size | .281 | .281 | .281 | .281 | .281 | .281 | .281 | .281 | .281 | .281 |

TABLE 4

Spec: 155C
Size: 9/32

| | | | | | | | | |
|---|---|---|---|---|---|---|---|---|
| Average Tensile | Mean | 155.706 | Std Dev | 2.179 | Minimum | 152.236 | Maximum | 159.188 |
| Predicted Tensile | Mean | 154.902 | Std Dev | 1.030 | Minimum | 153.089 | Maximum | 156.777 |
| Tensile Delta | Mean | 0.588 | Std Dev | 1.977 | Minimum | −3.079 | Maximum | 3.974 |
| Tensile Test Std Dev | Avg Std Dev | 1.944 | Min Std Dev | 0.865 | Max Std Dev | 3.494 | | |
| Range of Tests | Avg Range | 6.023 | Min Range | 2.720 | Max Range | 8.530 | | |

TABLE 5

| Spec | 172H | 172H | 172H | 172H | 172H | 172H | 172H | 172H | 172H | 172H |
|---|---|---|---|---|---|---|---|---|---|---|
| Heat | 34352 | 34353 | 34354 | 34355 | 34355 | 35056 | 35057 | 35058 | 35377 | 35377 |
| C | 0.800 | 0.810 | 0.820 | 0.820 | 0.820 | 0.790 | 0.800 | 0.800 | 0.800 | 0.800 |
| Mn | 0.68 | 0.72 | 0.69 | 0.70 | 0.70 | 0.70 | 0.68 | 0.69 | 0.70 | 0.70 |
| P | .010 | .007 | .005 | .005 | .005 | .008 | .009 | .006 | .009 | .009 |
| S | .010 | .008 | .004 | .006 | .006 | .010 | .007 | .009 | .013 | .013 |
| Si | 0.23 | 0.23 | 0.24 | 0.26 | 0.26 | 0.24 | 0.23 | 0.25 | 0.23 | 0.23 |
| Ni | 0.07 | 0.08 | 0.06 | 0.08 | 0.08 | 0.06 | 0.06 | 0.06 | 0.07 | 0.07 |
| Cr | 0.16 | 0.15 | 0.14 | 0.14 | 0.14 | 0.15 | 0.14 | 0.14 | 0.14 | 0.14 |
| Mo | 0.013 | 0.014 | 0.012 | 0.018 | 0.018 | 0.023 | 0.020 | 0.024 | 0.017 | 0.017 |
| Cu | 0.21 | 0.22 | 0.18 | 0.23 | 0.23 | 0.19 | 0.18 | 0.19 | 0.24 | 0.24 |
| V | .037 | .038 | .046 | .046 | .046 | .044 | .047 | .047 | .039 | .039 |
| N | .0056 | .0048 | .0052 | .0048 | .0048 | .0056 | .0048 | .0057 | .0056 | .0056 |
| B | .0001 | .0001 | .0001 | .0001 | .0001 | .0001 | .0001 | .0001 | .0002 | .0002 |
| Ti | .001 | .001 | .001 | .001 | .001 | .001 | .001 | .001 | .001 | .001 |
| Sn | .018 | .010 | .011 | .011 | .011 | .010 | .011 | .010 | .011 | .011 |
| Al | .001 | .001 | .001 | .001 | .001 | .001 | .001 | .002 | .001 | .001 |
| Cb | .001 | .001 | .001. | .001 | .001 | .001 | .001 | .001 | .001 | .001 |
| As | .0070 | .0070 | .0080 | .0070 | .0070 | .0080 | .0080 | .0070 | .0080 | .0080 |
| Pred Tens | 170.3 | 172.1 | 173.3 | 174.8 | 174.8 | 170.4 | 170.9 | 171.6 | 170.8 | 170.8 |
| Pred Size | .438 | .438 | .438 | .438 | .438 | .438 | .438 | .438 | .438 | .438 |

TABLE 6

| Spec: 172H Size: 7/16 | | | | | | | | |
|---|---|---|---|---|---|---|---|---|
| Average Tensile | Mean | 172.183 | Std Dev | 1.893 | Minimum | 168.060 | Maximum | 174.790 |
| Predicted Tensile | Mean | 172.324 | Std Dev | 1.510 | Minimum | 170.270 | Maximum | 174.838 |
| Tensile Delta | Mean | −0.184 | Std Dev | 1.772 | Minimum | −3.991 | Maximum | 1.828 |
| Tensile Test Std Dev | Avg Std Dev | 1.924 | Min Std Dev | 1.035 | Max Std Dev | 2.858 | | |
| Range of Tests | Avg Range | 5.502 | Min Range | 2.410 | Max Range | 8.250 | | |

TABLE 7

| Parameter Estimates | Coefficients | Standard Error | t Statistic | P-value | Lower 95% | Upper 95% |
|---|---|---|---|---|---|---|
| Intercept | −5.856 | 3.373 | −1.736 | 0.083 | −12.473 | 0.761 |
| C | 240.221 | 9.486 | 25.325 | 0.000 | 221.612 | 258.829 |
| C^2 | −66.411 | 7.255 | −9.153 | 0.000 | −80.645 | −52.178 |
| Mn | 26.645 | 1.407 | 18.932 | 0.000 | 23.884 | 29.406 |
| P | 142.648 | 24.331 | 5.863 | 0.000 | 94.916 | 190.380 |
| S | −37.868 | 13.239 | −2.860 | 0.004 | −63.841 | −11.895 |
| Si | 26.008 | 2.925 | 8.892 | 0.000 | 20.269 | 31.746 |
| Ni | −8.229 | 2.958 | −2.782 | 0.005 | −14.032 | −2.426 |
| Cr | 60.440 | 9.464 | 6.386 | 0.000 | 41.874 | 79.005 |
| Mo | 28.728 | 11.904 | 2.413 | 0.016 | 5.374 | 52.081 |
| Cu | 17.449 | 1.652 | 10.564 | 0.000 | 14.208 | 20.689 |
| V | 185.070 | 5.147 | 35.956 | 0.000 | 174.972 | 195.167 |
| N | 152.339 | 59.500 | 2.560 | 0.011 | 35.613 | 269.065 |
| size | −36.941 | 2.982 | −12.390 | 0.000 | −42.790 | −31.092 |
| Cr(size) | −47.838 | 28.443 | −1.682 | 0.093 | −103.637 | 7.961 |

TABLE 8

| Analysis of variance | df | Sum of Squares | Mean Square | F | Significance F |
|---|---|---|---|---|---|
| Regression | 14 | 355362.784 | 25383.056 | 7004.652 | 0 |
| Residual | 1301 | 4714.489 | 3.624 | | |
| Total | 1315 | 360077.274 | | | |

TABLE 9

| Regression Statistics | |
|---|---|
| Multiple R | 0.9934 |
| R Square | 0.9869 |
| Adjusted R. Square | 0.9868 |
| Standard Error | 1.9036 |
| Observations | 1316 |

In the present example, working ranges were established for each element as follows: Carbon 0.4–0.9%, Manganese 0.4–1.0%, Phosphorous 0–0.030%, Sulfur 0–0.030%, Silicon 0.15–0.35%, Nickel 0–0.20, Chromium 0–0.30, Molybdenum 0–0.05%, Copper 0–0.35%, Vanadium 0–0.12%, and Nitrogen 0–0.009%.

The resulting equation (6) has a coefficient of correlation of 0.987. The root mean square error, "s" estimates the standard deviation of the random error and has a value of 1.9 for the test data obtained.

The Melt Shop Process

Figure 5:
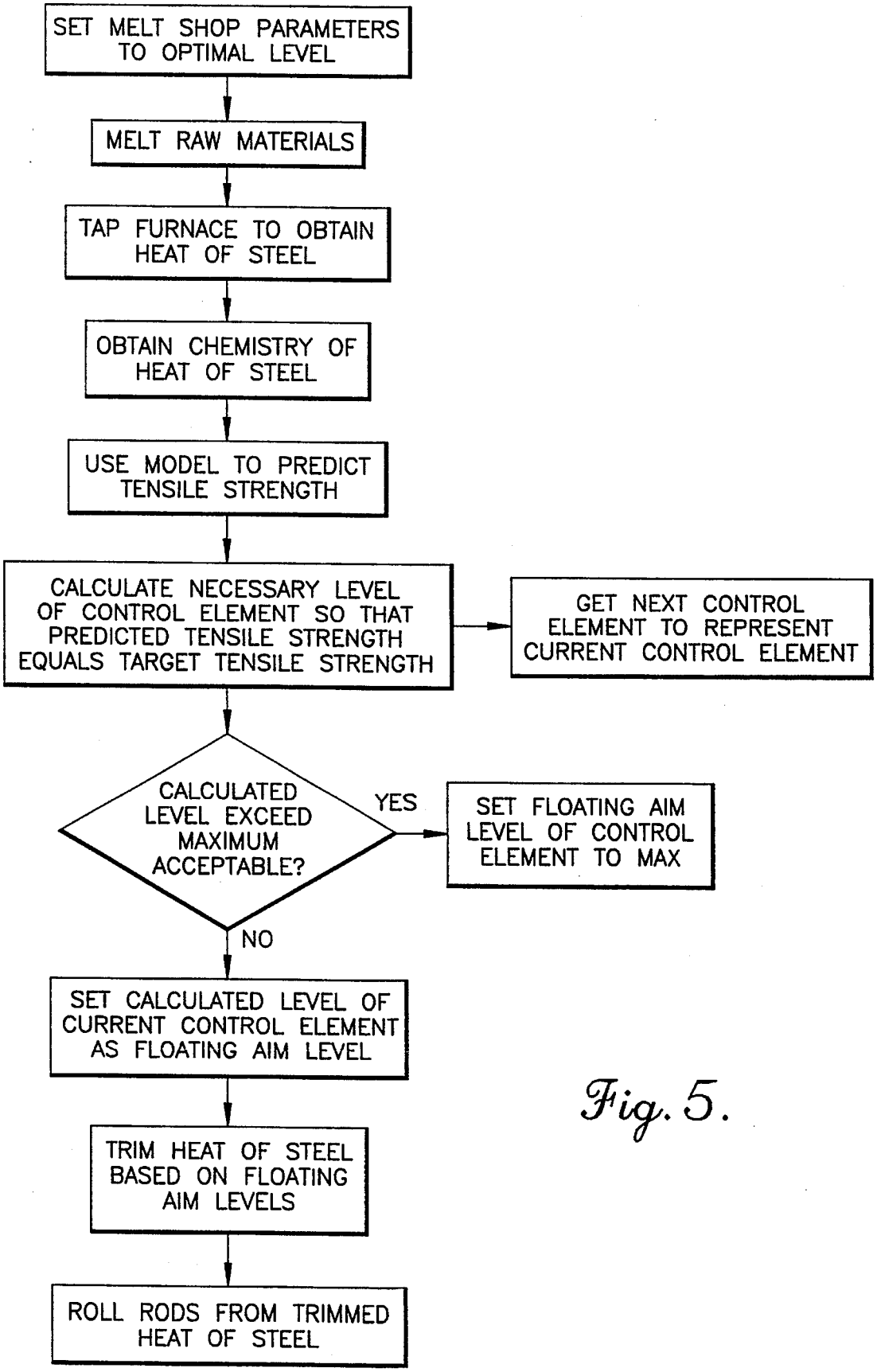
FIG. 5 illustrates a flowchart showing the processing sequence within the rod manufacturing process which utilizes the present empirical model to produce rods having the target tensile strength.

Once the above model has been established to predict accurately the average tensile strength of a lot for a given rod manufacturing process set up based upon that lot's chemistry, the model is used to produce rods with a target/desired tensile strength designated by the buyer. This process is illustrated in FIG. 5.

The instant rod manufacturing process is maintained in the optimal operating condition as used when obtaining the above model (step 100). This optimal condition includes an optimal cooling practice which will result in a microstructure within the rod for the best combination of strength and ductility. Any deviation from this cooling practice could have a negative impact upon the rod's properties. For example, slowing the cooling rate to achieve a lower tensile strength for a given chemistry will result in larger pearlite inter-lamallar spacing. This, in turn is generally perceived to reduce the ductility, and thus the drawability of the rod into wire. Thus, it is advantageous to maintain the rod manufacturing process at its optimal cooling setting.

The present rod manufacturing process is operated to adjust the chemistry of each heat of steel or lot based upon the empirical model developed above. According to the present method, initially, raw material is melted in the furnace (such as an arc furnace) (step 102). Once the lot is melted, the furnace is tapped and a ladle is filled (step 104), thereby creating a lot or heat of steel. This heat of steel is tested to determine the percentage content of each element therein (step 106). These tested element percentages, along with the target rod size and the corresponding "intercept" are entered into the model discussed above (i.e. equation 6) to predict the corresponding tensile strength which will be afforded to rods from this heat of steel (step 108). Next, the percentage of the first control element within the model (equation 6) is adjusted until the predicted tensile strength equals that of the desired tensile strength (step 110). This resulting percentage for the control element represent a "floating" aim level for the percentage content of the control element which should be included within the heat of steel to obtain the desired tensile strength.

Once the first floating aim level is obtained, it is compared with a maximum allowable percentage for that control element (step 112). For instance, in the preferred embodiment, the first control element represents carbon. In high carbon rods, it is preferable that the maximum carbon content does not exceed 0.90, since an amount above 0.90 is detrimental to ductility. Thus, if it is determined (step 112) through the model that, in order to achieve the target tensile strength, the heat of steel must include more than 0.90 percent carbon, processing moves to step 114. At step 114, the carbon/current control element level is set to its maximum acceptable level. Thereafter, in step 116 the current control element becomes the next/second control element (e.g., vanadium) and the analysis is repeated with the second control element.

More specifically, the model is utilized to determine the amount of a second control element which is necessary to obtain the desired tensile strength assuming that the first control element is set at its maximum acceptable level. Once the necessary amount of the second control element is calculated, this amount is compared with its maximum acceptable amount. If the necessary amount exceeds its maximum, steps 114, 116 and 110 are repeated. This process is repeated until the predicted tensile strength equals the desired tensile strength and this predicted tensile strength is based on a combination of control elements which does not exceed maximum acceptable levels.

When step 112 is answered in the negative, the calculated levels for the control elements are set as the floating aim levels for each of the control elements (step 118). Next, these floating aim levels are compared with the actual levels of each control element within the heat of steel. If the actual and floating aim levels are not equal, the heat of steel is trimmed by adding an amount of each control element sufficient to render the actual level of the control elements equal to that of the floating aim level (step 120). Thereafter, the trimmed lot is used to produce hot rolled rods (step 122).

By utilizing this procedure, the subject invention eliminates the affect of any variation within the residual elements upon the resulting tensile strength. Heretofore, the buyer was only able to specify the grade of steel, which included a range of acceptable residual levels, with the expectation of achieving rods having a tensile strength within a target range. According to the present invention, the exact level of residuals within a specific heat of steel is considered and the control elements are adjusted to meet a target tensile strength. The instant invention further prevents variations within the normal alloying elements, such as silicon and manganese, upon the resulting tensile strength by adjusting the floating aim level of the control elements based on the exact levels of the alloying elements.

TABLE 10

| Full Range AISI Grades | | | | | | |
|---|---|---|---|---|---|---|
| GRADE | No. of Heats | Rod Size in. (mm) | Spec. C Range % | Std. Dev. C % | Avg. TS ksi (MPa) | Std. Dev. of TS ksi (MPa) |
| 1055 | 1084 | 7/32 (5.5) | .50–.60 | 0.027 | 132.1 (910) | 4.60(31.7) |
| 1070 | 348 | 7/32 (5.5) | .65–.75 | 0.031 | 156.2(1077) | 5.86(40.4) |
| | | | | Typical Standard Deviation = | | 5.23(36.1) |

TABLE 11

| Restricted C & Mn AISI Grades | | | | | | |
|---|---|---|---|---|---|---|
| 1057M | 27 | 7/32 (5.5) | .54–.58 | 0.010 | 132.8 (916) | 2.44(16.8) |
| 1063M | 20 | 7/32 (5.5) | .62–.66 | 0.012 | 142.4 (982) | 2.28(15.7) |
| 1069M | 77 | 7/32 (5.5) | .70–.75 | 0.018 | 153.8(1060) | 5.32(36.7) |
| 1070M | 12 | 7/32 (5.5) | .66–.70 | 0.013 | 158.3(1091) | 4.65(32.1) |
| 1074M | 37 | 7/32 (5.5) | .72–.77 | 0.015 | 159.1(1097) | 4.05(27.9) |
| 1074M | 21 | 7/32 (5.5) | .71–.75 | 0.008 | 164.5(1140) | 3.01(20.8) |
| 1074M | 35 | 7/32 (5.5) | .76–.80 | 0.013 | 172.6(1190) | 3.24(20.8) |
| | | | | Typical Standard Deviation = | | 3.57(24.6) |

TABLE 12

| Melt-To-Tensile Grades | | | | | | |
|---|---|---|---|---|---|---|
| 130 | 57 | 7/32 (5.5) | .50–.60 | 0.012 | 130.1 (897) | 1.83(12.6) |
| 132 | 171 | 7/32 (5.5) | .52–.60 | 0.011 | 132.3 (912) | 2.20(15.2) |
| 135 | 133 | 7/32 (5.5) | .53–.63 | 0.013 | 135.2 (932) | 1.85(12.8) |
| 137 | 100 | 7/32 (5.5) | .55–.63 | 0.013 | 136.8 (943) | 2.01(13.9) |
| 140 | 62 | 7/32 (5.5) | .56–.66 | 0.012 | 139.7 (963) | 2.22(15.3) |
| 155 | 15 | 7/32 (5.5) | .66–.76 | 0.010 | 155.9(1075) | 1.95(13.4) |
| 160 | 17 | 7/32 (5.5) | .69–.79 | 0.012 | 159.8(1102) | 2.81(19.4) |
| | | | | Typical Standard Deviation = | | 2.12(14.6) |

Tables 10–12 illustrate the improvements in accuracy for calculating the tensile strength of the present invention over the existing systems. Tables 10 and 11 illustrate two conventional systems. In the first, a grade designation system is used in which the standard chemistries designated based upon AISI/SAE10XX Series. In this example, heats of steel meeting the 1055 and 1070 grade specifications were used in the analysis. The second conventional grade designation system is the modified AISI type grade system which restricts carbon and manganese ranges. The second grading system is typical of most of the customer specifications in use today. As shown in Table 11, seven representative melt specifications with sufficient data for analysis were selected for evaluation. These grades restricted carbon ranges as shown in column 5 of Table 11 and manganese ranges to 0.20 percent or less.

Table 12 corresponds to the present invention and utilizes grades corresponding to those of the first two conventional systems. In the example of the present system, the target tensile strength is used as the grade designation and heats of steel with a predicted tensile strength within +/– 3 ksi (20 Mpa) of the target tensile strength.

The standard deviation of the data set is used as the measurement to compare the variation of the heat to heat tensile strength for each grade designation. As illustrated in Table 10, the standard deviation values of the heat to heat tensile strengths of all of the lots meet the full chemical range of the two standard AISI grades which were 4.60 ksi (31.7 Mpa) for a 1055 grade, and 5.86 ksi (40.4 Mpa) for a 1070 grade. The typical standard deviation for the full AISI grades evaluated was 5.23 ksi (36.1 Mpa). Table 11 illustrates the standard deviation values of the average tensile strengths in AISI grades with restricted carbon and manganese ranges. The typical standard deviation of heat to heat tensile strength was 3.57 ksi (24.6 Mpa). This represents a slight improvement over the full AISI range.

As illustrated in Table 12, the tensile strengths and standard deviations for rods produced by the instant invention are significantly better. The instant invention provided a standard deviation of only 2.12 ksi (14.6 Mpa). These results indicate a 40% reduction of heat to heat tensile strength variation compared to the restricted AISI grades and a 60% reduction compared to the full AISI range.

It is also significant to note the ability of the instant invention to meet the target tensile strength of the grade. As previously noted, the grade designation number is the target tensile strength in ksi. Within Table 12, the instant grades had an average tensile strength within 1 ksi (7 Mpa) of the target tensile strength.

The foregoing specific values are only representative and are not intended to limit the invention in any way. For instance, the particular coefficients within the model will vary depending upon the specific rod manufacturing process being utilized and the settings of the processing parameters therein. Moreover, in the instant example, a single control element (carbon) is being used, and the non-linear affects are only considered with respect to one element (e.g. carbon). However, additional non-linear variables may be included to account for the non-linear affects of other elements upon the resulting tensile strength. Similarly, in the present example, the affect of the rod size upon the impact of the tensile strength component attributed by chromium has only been considered. However, additional similar variables may be added to account for the affects of rod size upon the tensile strength contribution of other elements.

Optionally, the tensile strength contribution $T_{sz\text{-}var}$ of the size dependent elements, particularly the hardenability elements, may be modeled in an alternative manner. As explained above, certain elements contribute a variable amount to tensile strength. This variable amount is modeled, as shown in equation (4), based on the rod size since the rod size is easily quantitized and maintains a known relation to the amount of variation at issue. However, in actuality and at a more fundamental level, the variation in an elements contribution to tensile strength is primarily dependent upon, and dictated by, the rate at which the resulting rod cools. As the cooling rate increases (i.e. grows faster), the contribution to tensile strength of the elements at issue also increases. The rod size is used to measure this change in tensile strength since the rod size maintains a known relation to the cooling rate. As the rod size increases, the cooling rate decreases as does the tensile strength. Thus, the change in tensile strength contribution may be modeled indirectly based on the rod size or directly based on cooling rate. To do so, the cooling rate would merely need to be quantized as a control measurement, and an equation produced modeling its relation to tensile strength in place of the rod size dependent equation (4).

Optionally, the model may be modified to account for variations in the rod manufacturing process parameters. For instance, if it were desirable to vary the cooling system in order to optimize this system for various rod sizes, variables could be added to the model to account for such variation. As noted above, the primary parameters within the cooling system which effect the resulting rod tensile strength are conveyor speed and air flow rate/volume (a secondary parameter is laying head temperature). Thus, a cooling system component $T_{cool}$ may be added to the general equation (1) to account for tensile strength variations attributed to the cooling system. The cooling system component $T_{cool}$ may represent a linear or non-linear relation to tensile strength, depending upon the particular cooling system. For instance, certain cooling systems utilize multiple stages, each of which affords separate control over the conveyor speed and air flow rate/volume. Thus, if each stage afforded a linear effect upon tensile strength, the cooling system component $T_{cool}$ would represent a summation of the effect of each stage, such as by the following equation:

$$T_{cool} = \sum_{m=1}^{M} (A_m CONV_m)(B_m FLOW_m); \tag{7}$$

where A and B represent coefficients for the conveyor speed and air flow of the nth stage, $CONV_m$ represents the conveyor speed of the mth stage, $FLOW_m$ represents the air flow rate of the mth stage and M represents the total number of stages.

Alternatively, the effects of the cooling system may be accounted for within the components of tensile strength already illustrated in equation (6). For instance, if the particular cooling system is found to afford a linear effect upon the contribution to tensile strength of the elements, equation (2) may be rewritten as follows:

$$T_{elmt} = \sum_{n=1}^{N} \sum_{m=1}^{M} \alpha_{mn} ELMT_n (CONV_m)(FLOW_m); \tag{8}$$

where $CONV_m$ and $FLOW_m$ represent the conveyor speed and air flow rate/volume of the mth stage, $ELMT_n$ represents the nth element and $\alpha_{mn}$ represents the coefficient of the mth stage for the nth element. Similarly, if the cooling system implemented affords a non-linear effect upon the tensile strength, the non-linear component $T_{poly}$ of equation (1) may be modified in a similar manner to account for conveyor speed and air flow rate/volume. Further, if the cooling system implemented affords only a noticeable effect upon the size dependent elements, the size dependent component $T_{sz\text{-}var}$ of equation (1) may be modified.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A method for producing a rod, within a rod manufacturing process, having a predetermined target value for at least one critical mechanical property based on an empirical model of said rod manufacturing process which predicts a value for said critical property based upon a chemistry of said rod, said method comprising the steps of:

producing, within said rod manufacturing process, a lot of molten raw material to form said rod, said lot being formed of a plurality of chemical elements which affect said critical mechanical property of said rod, said plurality of elements including at least one chemical control element having a substantial affect upon said critical mechanical property;

analyzing at least one sample of said lot to obtain a first chemistry therefor, said first chemistry including a current sampled level for each of said chemical elements that affect said critical property;

applying said chemistry to said empirical model to calculate a floating aim level of said at least one chemical control element, said floating aim level equaling a level of said chemical control element needed to render the predicted value of said critical property equal to said target value for said critical property; and adjusting said first chemistry of the lot such that said predicted critical property equals said target value by adding to said lot an amount of said chemical control element equal to a difference between said floating aim level and said current sampled level.

2. A method of producing a rod according to claim 1, wherein said method further comprises the steps of:

determining whether a level of a first chemical control element calculated with said model, necessary to achieve said target value of said critical property, exceeds a maximum acceptable level for said chemical control element;

when said maximum acceptable level is exceeded, setting a first floating aim level corresponding to said first chemical control element equal to said maximum acceptable level to obtain a second chemistry, and applying said second chemistry to said empirical model to calculate a second floating aim level corresponding to a second chemical control element needed to render said predicted value of said critical property equal to said target value for said critical property.

3. A method of producing a rod according to claim 1, wherein said method further comprises the step of:

initially setting and retaining all processing parameters for said rod manufacturing process to operate at an optimal level with a maximum rod throughput and with said rods having optimal mechanical properties throughout said process.

4. A method of producing a rod according to claim 1, wherein said method further comprises the steps of:

creating said empirical model while all processing parameters for the rod manufacturing process are set to optimal levels; and retaining the processing parameters for said rod manufacturing process at said optimal levels throughout production.

5. A method of producing a rod according to claim 1, wherein said empirical model includes a polynomial component corresponding to a non-linear relationship between said critical property of the rod and an amount of at least one of said chemical elements forming said lot of raw material.

6. A method of producing a rod according to claim 1, wherein said empirical model includes a size dependent component which varies based upon a diameter of said rod, said size dependent component corresponding to a dependence of an affect of at least one chemical element upon said critical property with respect to a diameter of said rod.

7. A method of producing a rod according to claim 1, wherein said plurality of chemical elements include at least one size dependent chemical element which affects said critical property by an amount that varies dependent upon a diameter of said rods to be formed, said empirical model including a chemical element variation component corresponding to said at least one size dependent element.

8. A method of producing a rod according to claim 1, wherein said critical property is a tensile strength of said rods.

9. A method of producing a rod according to claim 1, wherein said at least one chemical control element includes at least one of carbon and vanadium.

10. A method of producing a rod according to claim 5, wherein said polynomial component in said model corresponds to a square of a level of said chemical control element.

11. A method of producing a rod according to claim 7, wherein said size dependent chemical element is chromium.

12. A method of producing a rod according to claim 1, wherein said rods are high carbon rods.

13. A machine for predicting a resulting critical mechanical property of a resultant medium produced by a manufacturing process having manufacturing parameters set at fixed levels, said medium being formed of a test chemistry comprising test levels of at least two chemical elements which affect said critical mechanical property, said at least two chemical elements including at least one chemical control element, said machine comprising:

means for obtaining a plurality of base chemistries and a corresponding plurality of base values of a critical mechanical property for a plurality of test samples of a medium produced by a manufacturing process having manufacturing parameters set at fixed levels;

means for calculating, based on said plurality of base chemistries and base values, a linear component corresponding to a linear relation between said critical mechanical property and a percentage content of said at least two chemical elements included in a chemistry;

means for calculating, based on said plurality of base chemistries and base values, a non-linear component corresponding to a non-linear relation between the critical mechanical property and a percentage content of said at least one chemical control element; and means for calculating, based on said linear and nonlinear components, a resulting critical mechanical property of a medium, produced by the manufacturing process having the manufacturing parameters set at the fixed levels, when the medium is formed of a test chemistry comprising test levels of said at least two chemical elements including a test level of said at least one chemical control element.

14. A machine according to claim 13, further comprising means for calculating, based on said plurality of base chemistries and base values, a variable cooling rate component representing a variation in an affect upon said critical mechanical property contributed by a cooling rate dependent chemical element included within said at least two chemical elements.

15. A machine according to claim 13, further comprising means for calculating a size dependent component representing a variation in an affect upon said critical mechanical property due to a diameter of said medium formed with said test chemistry.

16. A machine according to claim 15, wherein said medium corresponds to a rod, said critical mechanical property corresponds to a tensile strength of said rod formed with said test chemistry and wherein said size dependent component corresponds to a tensile strength component attributed to a diameter of said rod.

17. A machine according to claim 13, wherein said critical mechanical property corresponds to a tensile strength of a medium formed with said test chemistry and wherein said non-linear component represents a summation of non-linear tensile strength components, each of which corresponds to one of said chemical control elements.

18. A machine according to claim 14, wherein said critical mechanical property corresponds to a tensile strength of a medium formed with the test chemistry and wherein said variable cooling rate component represents a summation of variable cooling rates, each of which corresponds to one of a plurality of cooling rate dependent chemical elements.

19. A machine according to claim 13, wherein said critical mechanical property corresponds to a tensile strength of a medium formed with the test chemistry and wherein said linear component corresponds to a summation of linear component tensile strengths, each of which is attributed by one of said chemical elements, and wherein a level of each of said linear component tensile strengths has a substantially linear relation to a level of a corresponding chemical element contained within said test chemistry.

20. A machine according to claim 13, wherein said critical mechanical property corresponds to a tensile strength of a medium formed with said test chemistry and wherein said non-linear component is calculated based on an equation:

$$T_{poly} = \sum_{i=1}^{I} \Delta_i (ELMT_{poly})_i^2;$$

where $T_{poly}$ represents the non-linear component of tensile strength, $\Delta_i$ represents the coefficient for the $i^{th}$ chemical element, $(ELMT_{poly})_i$ represents the percentage content by weight of the $i^{th}$ chemical element within the test chemistry of the medium and I represents the total number of chemical elements having a nonlinear tensile strength contribution.

21. A machine according to claim 14, wherein said critical mechanical property corresponds to a tensile strength of a medium formed with said test chemistry and wherein said variable cooling rate component is based on an equation:

$$T_{cool\text{-}rate} = \sum_{m=1}^{M} \Gamma_m (ELMT_{size})_m (\text{Size});$$

where $T_{cool\text{-}rate}$ represents the variable cooling rate component, $ELMT_{size}$ represent the percentage content of the $m^{th}$ cooling rate dependent chemical element which is sensitive to cooling rate, Size represents the medium size and $\Gamma_m$ represent the coefficient for the $m^{th}$ cooling rate dependent chemical element.

* * * * *